US006105794A

United States Patent [19]

Bauer

[11] Patent Number: 6,105,794

[45] Date of Patent: Aug. 22, 2000

[54] ADJUSTABLE SUPPORT BRACKET THAT SLIDES AND ADJUSTS WITHIN A CHANNEL

[76] Inventor: George E. Bauer, 2017 SW 146th St., Seattle, Wash. 98166

[21] Appl. No.: 08/861,772

[22] Filed: May 22, 1997

[51] Int. Cl.[7] ..... A47F 7/00

[52] U.S. Cl. ..... 211/94.01; 211/90.01; 211/103; 211/207; 211/208; 248/245; 248/250; 248/243; 248/235; 108/108

[58] Field of Search ..... 211/94.01, 103, 211/90.01, 207, 208, 248, 26, 182, 183, 187, 190, 69.5; 108/108; 248/245, 250, 243, 220.21, 220.22, 223.31, 297.31, 223.41, 225.11, 297.21; 52/36.6, 235; 312/111

[56] References Cited

U.S. PATENT DOCUMENTS

| | | | |
|---|---|---|---|
| 427,462 | 5/1890 | Crider | 248/244 |
| 711,759 | 10/1902 | Chmelitzek | 248/245 |
| 1,230,999 | 6/1917 | Crist | 248/245 |
| 1,286,376 | 12/1918 | Madsen | 248/225.11 X |
| 2,788,902 | 4/1957 | Nowicki | 248/250 X |
| 2,896,898 | 7/1959 | Penn | 248/245 |
| 2,937,766 | 5/1960 | Penn | 248/245 X |
| 2,976,001 | 3/1961 | Wulc | 248/220.22 |
| 3,256,658 | 6/1966 | Seery | 211/207 X |
| 3,779,499 | 12/1973 | Shell | 248/245 |
| 4,460,141 | 7/1984 | Svensson | 248/223.41 X |
| 4,506,484 | 3/1985 | Bartlett et al. | 52/235 X |
| 4,579,308 | 4/1986 | Jensen | 248/223.41 |
| 4,614,273 | 9/1986 | Ishii | 211/207 X |
| 4,655,353 | 4/1987 | Johnson et al. | 211/208 X |
| 4,666,117 | 5/1987 | Taft | 108/108 X |
| 4,819,901 | 4/1989 | McDonald | 248/250 |
| 4,895,331 | 1/1990 | Nehls | 108/108 X |
| 5,137,245 | 8/1992 | Lee | 248/220.22 X |
| 5,195,708 | 3/1993 | Marsh | 211/90.01 X |
| 5,356,104 | 10/1994 | Rosenberg et al. | 248/225.11 X |
| 5,456,435 | 10/1995 | Sweeney | 211/90.01 X |
| 5,470,139 | 11/1995 | Hsiao | 312/111 X |
| 5,615,854 | 4/1997 | Nomura et al. | 248/220.22 X |
| 5,645,177 | 7/1997 | Lin | 211/69.5 X |
| 5,676,258 | 10/1997 | Leyden et al. | 211/94.01 X |
| 5,690,239 | 11/1997 | Ballard | 211/187.01 X |
| 5,707,033 | 1/1998 | Holt et al. | 248/225.11 |

FOREIGN PATENT DOCUMENTS

| | | | |
|---|---|---|---|
| 1052719 | 12/1966 | United Kingdom | 248/250 |

*Primary Examiner*—Daniel P. Stodola
*Assistant Examiner*—Khoa Tran

[57] ABSTRACT

An adjustable support bracket having a unitary or multi-member bracket assembly can be used with a vertical channel (2) and rail (6) construction. Each bracket assembly can be positioned and secured at any location along the rail (6) and can accommodate a varying shelf thickness. More specifically, the multi-member bracket assembly includes a stabilizer member (12) and a support member (20) having similar shaped channel plates which when joined have a similar shape to the channel (2). A spring (30) mounted between the stabilizer and support members (12, 20) is contained between the rails (6). The spring (30) in conjunction with a containing lip (14) and a supporting lip (22) of the stabilizer and support members (12, 20), respectively, adjusts to clamp a shelf (32) therebetween. A securing screw (33) locks the bracket (10) at any shelving location by creating a space between the stabilizer and support members (12, 20) within the vertical channel (2).

15 Claims, 6 Drawing Sheets

Fig. 3B
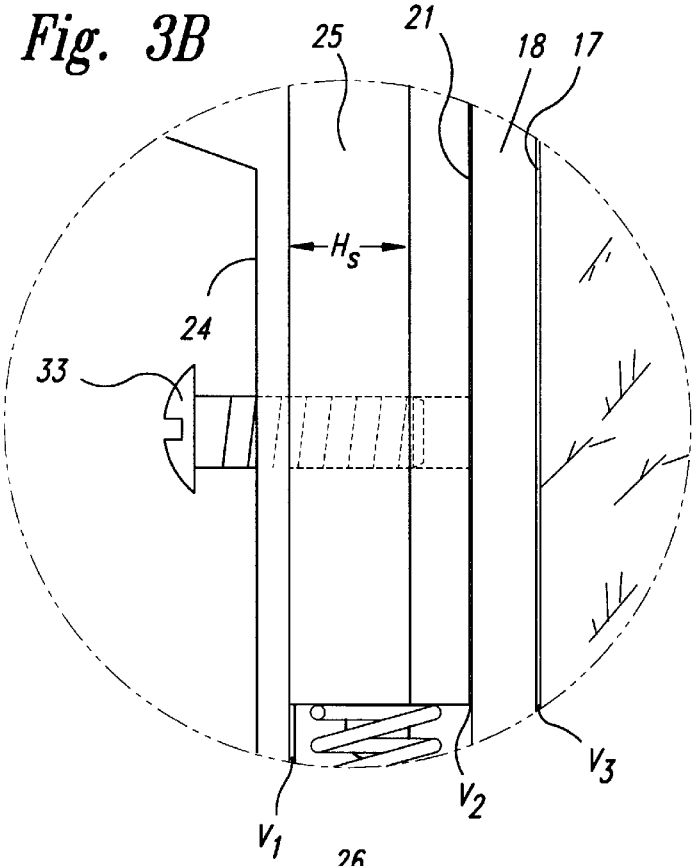
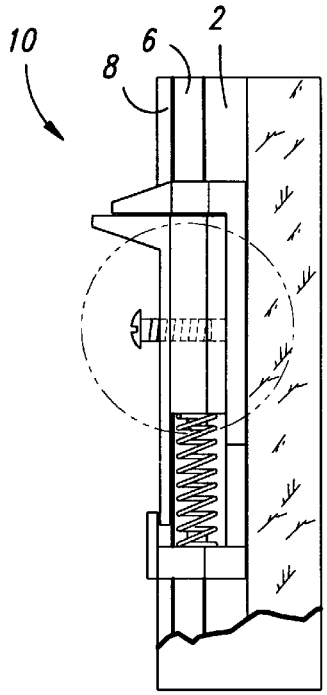
Fig. 3A
Fig. 3D
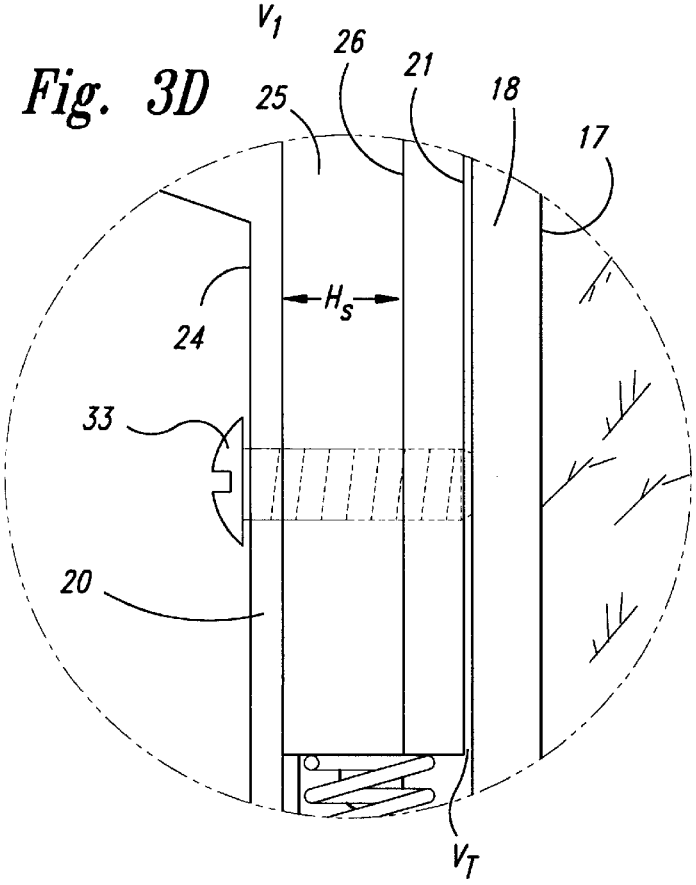
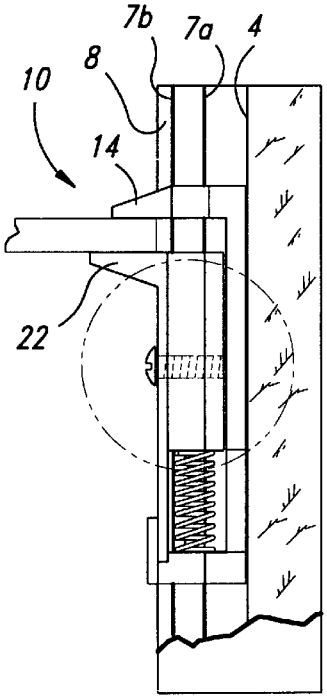
Fig. 3C

ADJUSTABLE SUPPORT BRACKET THAT SLIDES AND ADJUSTS WITHIN A CHANNEL

TECHNICAL FIELD

The present invention relates to a shelf bracket set having a support and a stabilizer with bases that nestle in a channel partially enclosed by side rails; and more particularly to a bracket set that may be positioned at any location along the rails and is adjustable to clasp shelving of varying width and thickness.

BACKGROUND OF THE INVENTION

Many shelving systems exist for displaying or storing items both in the personal and sales arenas. The most conventional method is an open or closed wall book case floor system. With this system, four brackets, typically L-shaped, lock into vertical rails having predetermined vertically spaced holes. A shelf, having a surface area to accommodate the planar surface provided by the brackets is placed on top of the four brackets. While this approach has gained a lot of acceptance in the field of display shelving, its' efficiency and efficacy is limited. With this system, not only does the user lose floor space because of the area that the system occupies, but also effective display space. Since the location of the display shelf is always dependent on the predetermined vertically spaced holes in the rails, there will always be a variable space between the top of the display item and the next shelf. Consequently, the vertical display area provided by the system can not be effectively and efficiently used with respect to varying display items.

To reduce the wasted floor space typical of the above conventional display method, storage or display systems have been developed using brackets supported by slatwall or mounted wall rail assemblies. However, like the above systems, mounted wall assemblies use predetermined rabbet or drilled positions to support the shelving brackets.

U.S. Pat. No. 5,356,104 by Rosenberg et. al., incorporated herein by reference, discloses one conventional wall display system. With this system, a slat wall hook or platform bracket is supported in a vertical slatwall by a sleeve member placed within the channel region of the slatwall. The sleeve member provides predetermined spaced apart latching means to support the brackets in use. However, as with the above floor display system, this system is limited to the predetermined mounting locations provided by the sleeve member.

U.S. Pat. No. 5,080,311 by Engstrom, incorporated herein by reference, illustrates a conventional shelf griping bracket for wall display system. Engstrom's bracket is attached to a mounted rail assembly having predetermined spaced apart shelf placement holes. Additionally, the bracket uses a retaining arm for a predetermined shelf thickness to reduce the movement of the shelf. If desired, Engstrom's bracket can receive various predetermined shelf thickness with its' multiple preset top arm structure. However, this system, like the above mentioned systems, still has the problem of effectively positioning the brackets as desired by the user so that the shelf spacing can be as effective as possible for the desired item to be displayed. Furthermore, because the construction of shelves of any material (e.g. glass, plastic, wood, metal, etc.) can vary in thickness, particularly when manufactured in other countries, the preset top arm structure will rarely provide the exact shelf thickness for effectively using the retraining arm of the shelf bracket. Consequently, the retaining arm of the above conventional bracket can only grip shelves that accommodate the predetermined thickness desired for a shelf.

Conventional shelf support systems having fixed shelf positioning locations can rarely provide an efficient and effective shelving structure for displaying items. Thus, it would be advantageous to develop a shelving bracket system in which the only limitation of where a shelf is to be placed is dictated by the size of the bracket or the wall for which the bracket is attached. In addition, it would be advantageous if a developed system could accommodate and clamp materials of any reasonable thickness of manufactured shelving material.

SUMMARY OF THE INVENTION

Briefly described, the present invention comprises a bracket assembly for use with a vertical channel and rail wall construction. In one preferred embodiment, the inventive bracket assembly has a unitary construction that includes a stabilizer and a support member coupled between a spacer member. The stabilizer member is shaped similar to the channel. The support member provides a support lip extending outwardly from the outer wall surface and includes a planar surface for receiving and supporting an object to be stored or displayed. The spacer member extends from the channel to the outer wall surface of the rail and is attached to a central location of the stabilizer and the support members. To secure the inventive bracket at a desire location along the channel and rail wall, a locking element is fixably mounted through the spacer and stabilizer member and into the channel region at the desired bracket/shelf location.

One advantage of the unitary bracket assembly is its ability to provide a bracket which can be inverted and used with other brackets to support a shelf.

In another preferred embodiment, the inventive bracket assembly has a multi-member construction that includes a stabilizer and support member used in conjunction with a channel and rail wall construction. The stabilizer member includes a containing lip and a barrier wall attached perpendicularly to a first end and a second opposite end, respectfully, of the stabilizer member. The support member includes a supporting lip attached perpendicular to and at one end of the support member, and is shaped to fit within the stabilizer member laterally spaced between the containing lip and barrier wall. A securing element fixably mounted through the support member includes means for locking the support bracket assembly at a desired position on the wall within the channel. The adjoined stabilizer and support members include channel plate portions that conform to the shape of the channel, the containing and supporting lips provide a clamping structure adjustable on the wall rail, and the securing element is adjustable to lock the support bracket assembly at any location on the wall by means of separating the stabilizer and support members within said channel.

The inventive bracket can be used with a conventional slatwall or a preferred embodiment of slatrail which provides a similar channel construction as slatwall. The preferred embodiment of slatrail provides a groove or recess in the rail for accommodating the inventive bracket embodiments above. The recessed rail portion of the inventive slatrail allows for the inventive bracket to create a flush wall surface appearance while creating a guiding groove. Additionally, the recess rail portion provides lateral twisting support when the bracket is used in conjunction with heavy objects, channels that are not perpendicular to the floor surface, and/or when a channel dimension are not of standard construction.

An advantage of the present inventive unitary and multi-member bracket assembly is its ability to eliminate predetermined mounting locations for a shelving system. Unlike current shelving systems, the present invention provides a bracket for supporting a shelf at any desired vertical location along a display wall or between opposing sides of a cabinet. Additionally, depending on the desired display items, a single inventive bracket can shelf a light weight display object without the support of another bracket. If desired, multiple brackets of the present invention can be used in conjunction with one another to support a display shelf or heavier objects.

According the multi-member bracket assembly, the present invention has the advantage of being able to receive a shelf having any thickness, standard or not, due to the adjustability of the containing and supporting lips. Accordingly, it is an object of the present invention to simplify the use of shelving material having a thickness that is not necessarily an industry standard.

Another advantage of the present invention is its' ability to have the containing and supporting lips angled to accommodate a shelf placed at an oblique angle relative to the planar floor surface or the channel and rail wall construction.

Furthermore, the present invention provides a means to adjust shelf spacing to store or display small and light weight items of varying height that may be effectively grouped to maximize usage of shelf or cabinet space.

Further objects and advantages of this invention will become apparent from a consideration of the drawings and ensuing description, and the claims, which are incorporated wherein as part of the disclosure of the invention.

BRIEF DESCRIPTION OF THE DRAWINGS

FIGS. 3A–3D illustrate cross-sectional views of the embodiment shown in FIG. 1 and the method of securing the present invention.

DETAILED DESCRIPTION OF THE INVENTION

Figure 1:
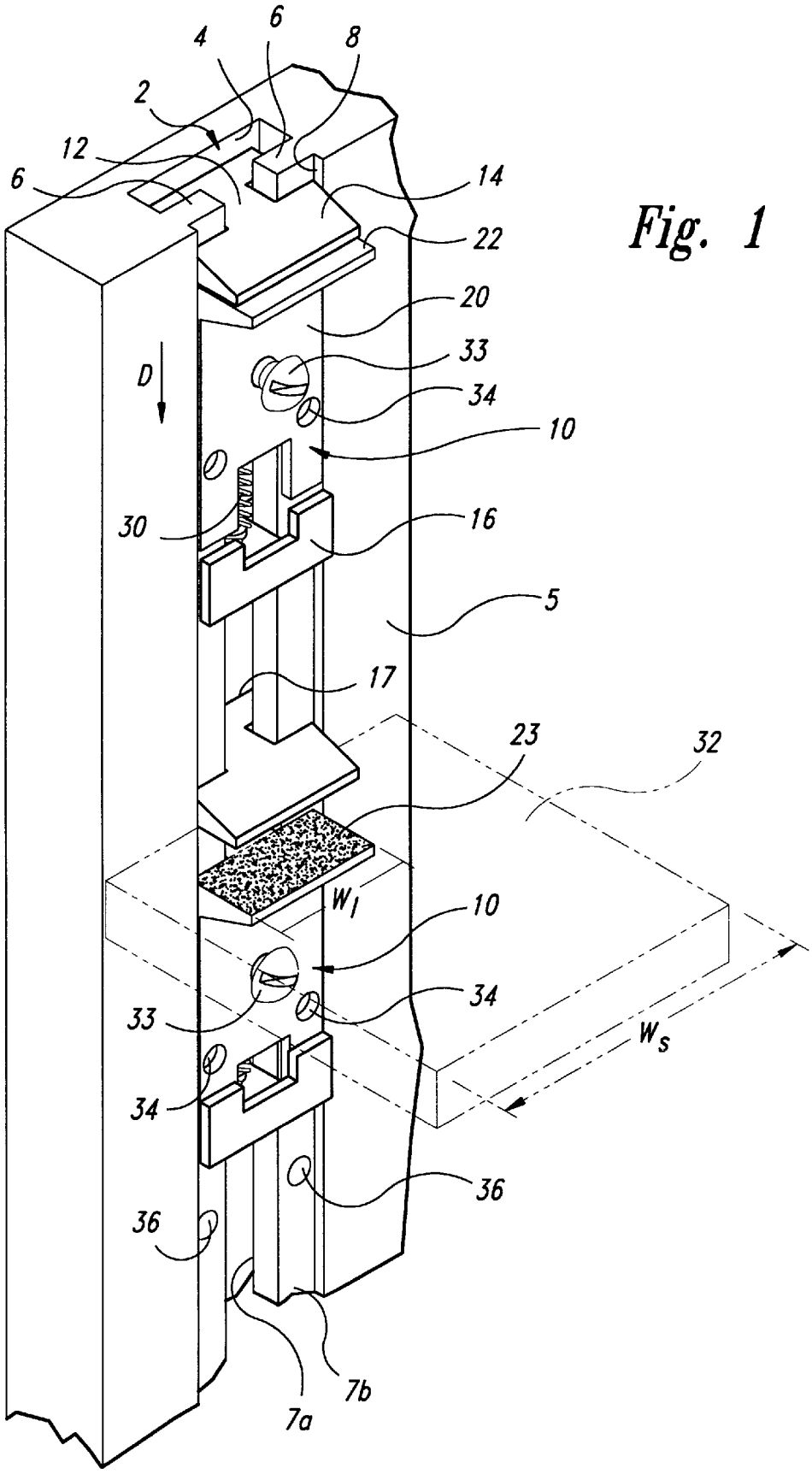
FIG. 1 illustrates a perceptive view of one preferred embodiment of the present invention utilized with the preferred inventive slatrail wall construction.
Figure 2:
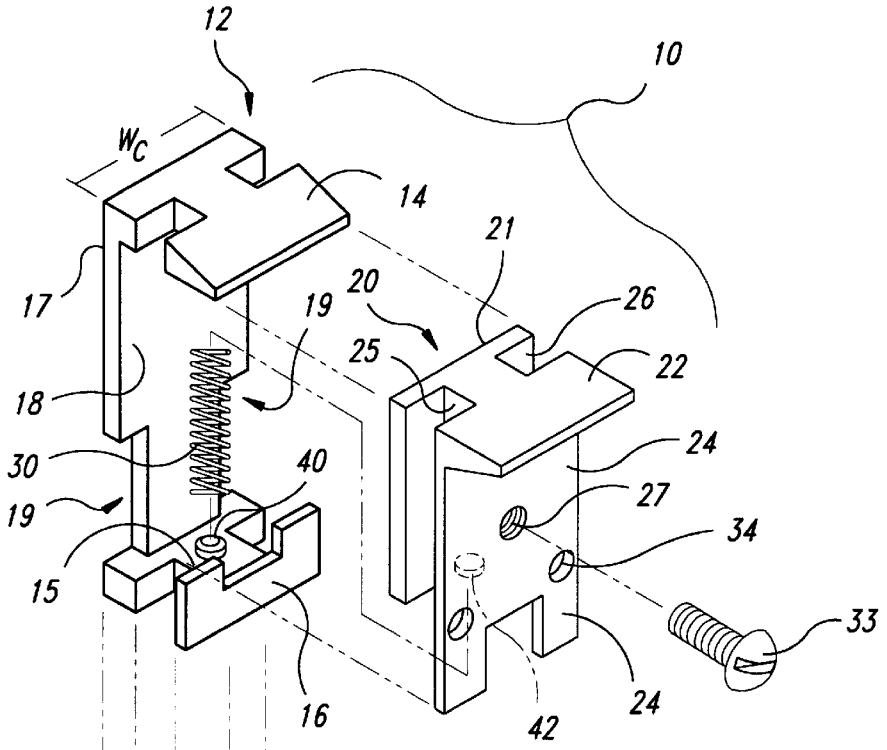
FIG. 2 illustrates a perspective exploded view of the embodiment shown in FIG. 1.
Figure 4A:
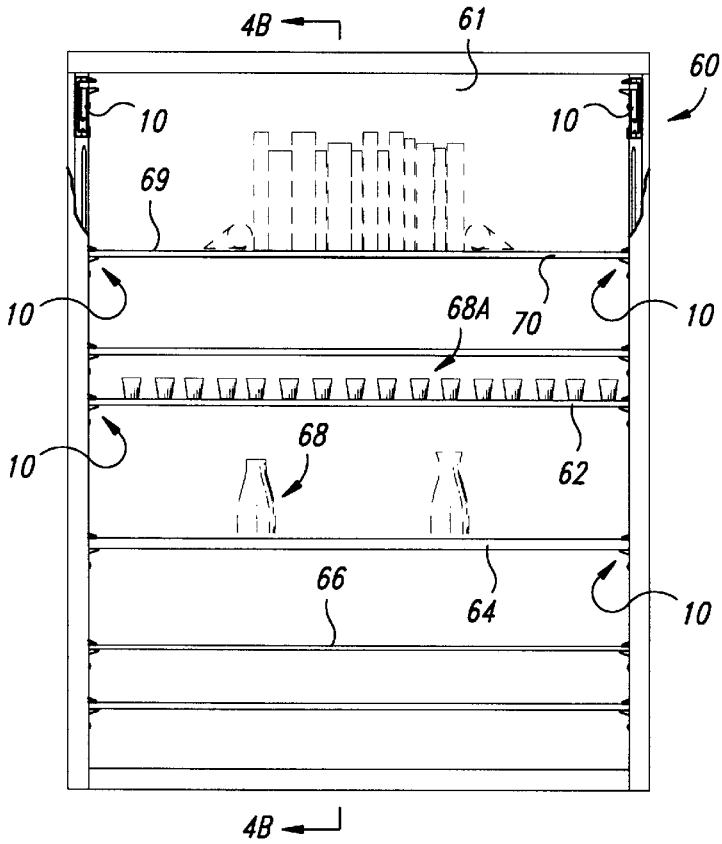
FIGS. 4A and 4B illustrate a front and cross-sectional view, respectively, of a preferred bracket and shelf assembly of the embodiment of FIG. 1.
Figure 4B:
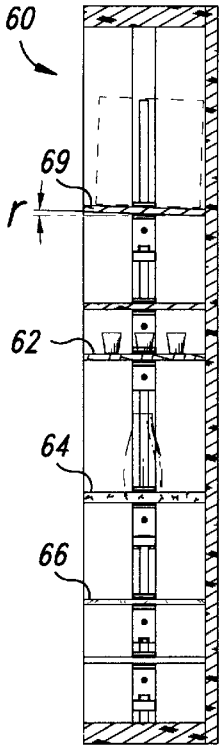
Figure 5:
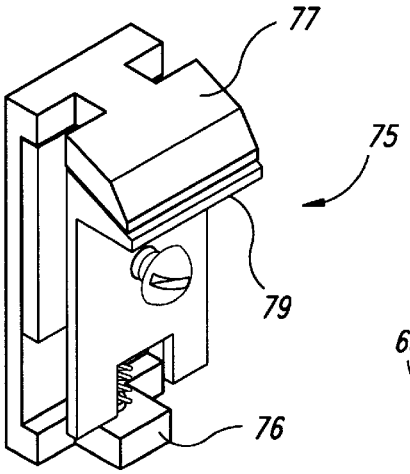
FIG. 5 illustrates a perspective view of another embodiment of the present invention.
Figure 6:
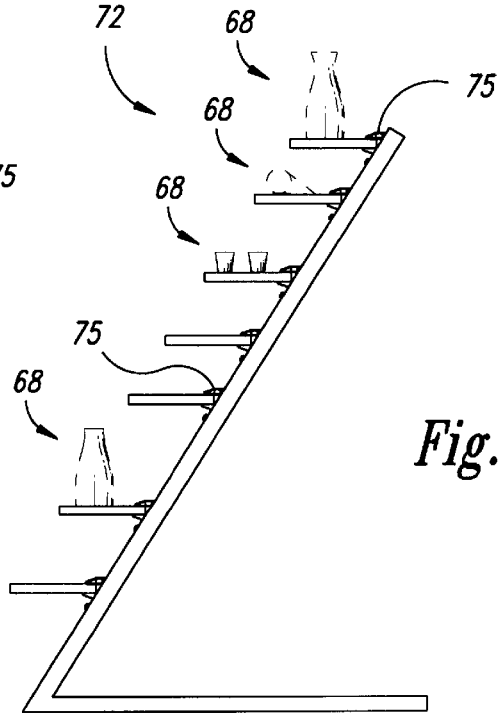
FIG. 6 illustrates a side view of the embodiment of FIG. 5 in conjunction with a portable or stand-alone shelf assembly.
Figure 7:
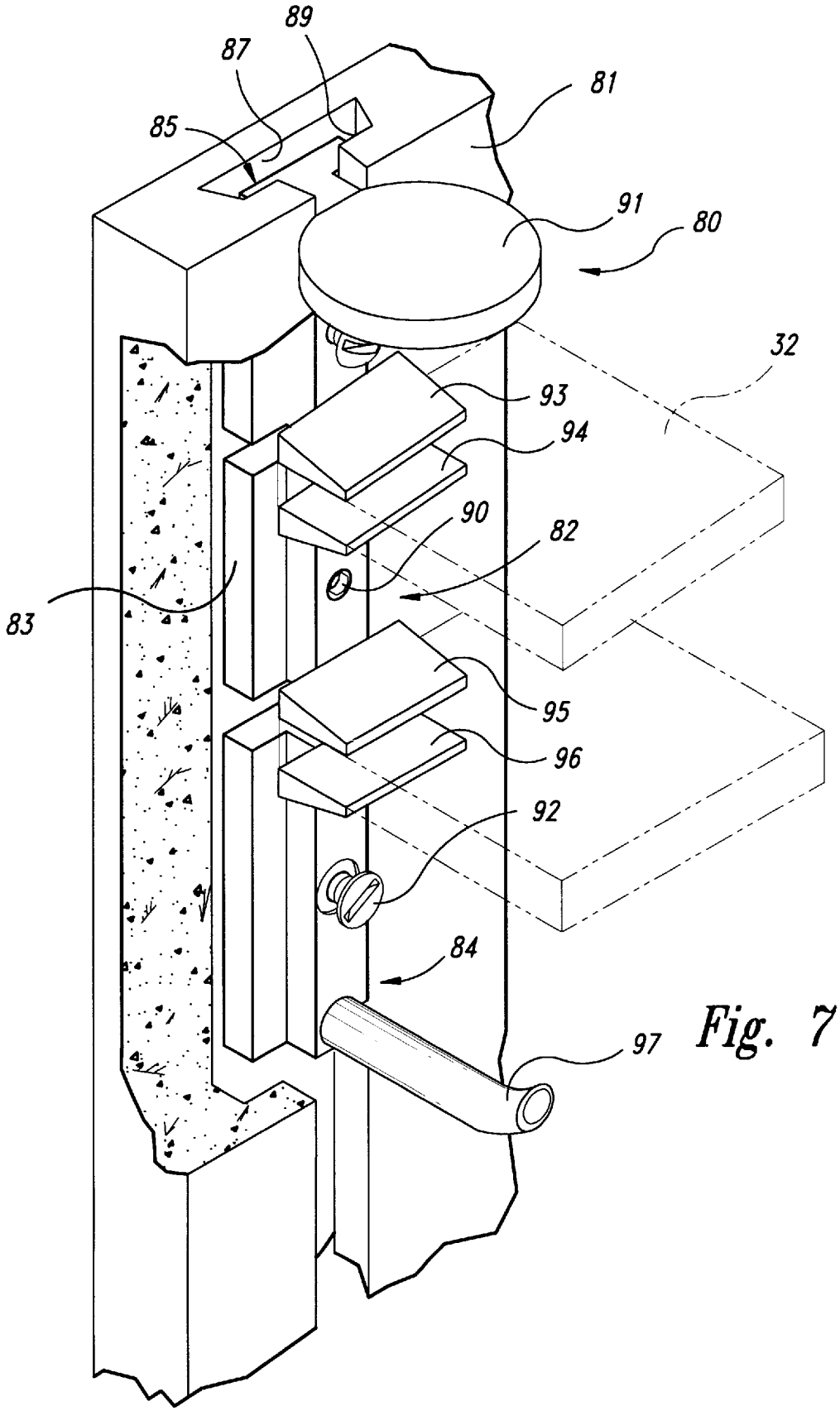
FIG. 7 illustrates a perspective view of a third embodiment of the present invention in conjunction with conventional slatwall.

The preferred shelf assembly embodiment of the present invention is illustrated generally in FIG. 1 and includes a multi-member shelf bracket 10 in conjunction with a section of slatrail 5. FIG. 2 illustrates a preferred manner of assembling the inventive shelf bracket 10 and slatrail 5, whereas FIGS. 3A and 3B show the means for locking the bracket 10 within the slatrail 5. FIGS. 4A and 4B illustrate a front and cross-sectional view of the inventive brackets of FIG. 1 installed in a preferred display unit. Various other preferred embodiments of the multi-member shelf bracket 10 are illustrated in FIGS. 5–6. Additionally, an unitary bracket embodiment having various styles of shelving platforms or a rod in conjunction with conventional slatwall is illustrated in FIG. 7.

The various embodiments of the inventive bracket assembly, multi-member and unitary construction, can be made by conventional injection molding techniques employing a plastic material, such as a polyresin like polyamide nylon or the similar. All embodiments of the inventive bracket assembly are preferably used in conjunction with slatrail, discussed below, or with conventional slatwall used in a vertical manner.

Conventional slatwall is typically manufactured with a wood fiber and glue construction in four by eight foot sheets. Various open channel sections extending the length of the sheet are equally spaced across the width of the sheet. When used for merchandise sale stores, the sheets are mounted to pre-framed walls such that the channel of the slatwall is provided parallel to the floor surface. To display the desired merchandise, t-shaped hooks or platforms are positioned into the horizontal channels and a single or multiple light weight objects are displayed, respectively. For example, a slatwall platform might be used to display a single light weight object similar to a shoe or a figurine, whereas a hook would more likely be used to display a number of similar watches, cooking utensils, or combs. Consequently, it is not surprising that experimentation has found that slatwall of the typical wood fiber and glue construction typically has a very low structural integrity. In other words, if heavy items are placed on the hooks or platforms, e.g. coffee mugs or pottery, the rails of the channels collapse, the hook or platform release form the channel, and the object(s) on display is lost or scatter across the floor. Shelf bracket systems for portable display units and furniture typically demand different appearance and functional requirements than those common with merchandise sales that use slatwall.

Consequently, one embodiment of the inventive bracket assembly includes an inventive channel and rail wall construction that is cosmetically more appealing and functionally more robust. This inventive slatrail wall construction provides the same advantages as listed above for slatwall, however, in addition, it satisfies the necessary requirements for a more decorative and functionally robust display necessary for furniture or portable display units.

Referring to FIG. 1, an upper and lower multi-member bracket 10 of the preferred embodiment in conjunction with a section of slatrail 5 is illustrated. The upper and lower brackets 10 are structurally identical, however, the lower bracket 10 is locked in place along the channel 2 by the securing screw 33 and shows a sectional view of a shelf 32 clamped in place. Additionally, the lower bracket 10 illustrates optional securing holes 34 for the brackets which can be added before or after the bracket is locked in place.

Each bracket 10 includes a stabilizer member 12 and a support member 20. A spring 30 mounted vertically between the stabilizer and support members 12 and 20 is contained between the rails 6. The stabilizer member 12 provides a containing lip 14 attached to the top end of the stabilizer member 12 and a barrier wall 15 (see FIG. 2) and retaining plate 16 at the opposite end. A support lip 22 is attached perpendicularly to one end of the support member 20. Together, the containing lip 14 and support lip 22 clamps shelf 32 with the help of the spring 30. For assisting in clamping and securing the desired shelf, the texture of the surface 23 of the containing and support lips 14, 22 may be varied. For example, the surfaces may be manufactured to have a wash-board, sandpaper, or peak-and-valley type surface which could be particularly beneficial when used with shelves made from soft woods. On the other hand, a smooth surface that could receive a sponge like material could be particularly beneficial for a shelf made from hard wood, glass, metal or acrylic plastic.

For preferred display shelf stability, the ratio between the width Ws of a shelf 32 and the width $W_1$ of the containing or support lip 14, 22 should be about to three to one. In other words, if only one bracket 10 or two opposing brackets are used to support a shelf, it is preferable that the shelf width Ws is not more than three times the width W1 of the containing and support lips 14, 22. Of course, smaller or larger ratio would be governed by the footprint of items to be displayed or effect desired.

Once the shelf is clamped into place, a threaded hole within the support member 20 receives a securing screw 33. The securing screw 33 is threaded into and through support member 20 and applies pressure to stabilizer member 12. This pressure locks the bracket within the channel 2 by increasing the distance between the stabilizer and support members 12, 20. Further advancing the screw in the threaded hole increases the pressure on surface 18 of stabilizer member 12 and moves surface 17 of stabilizer member 12 into contact with channel floor 4, and at the same time moves surface 26 of support member 20 into contact with channel roof 7*a* the screw 33 need not be advanced more than is necessary for the bracket assembly 10 to bind firmly in the channel 2. The retaining plate 16 nestled above the recess 8 of slatrail 5 restrains the surface plate 24 of the support member 20 from lifting above the planar surface of slatrail 5 when securing screw 33. If slatwall (not shown) is used instead of slatrail 5, the bracket 10 will still function the same, however, the surface plate 24 of the support member 20 will rest on the surface of the slatwall.

With reference to lower bracket 10, two examples are shown for further securing the brackets in the channel 2 if desired. Typically, these embodiments would find use with unexpected heavier display items or for the display shelf locations that would not change for an extended period of time. The first technique involves the use of securing hole 34 and secondary receiving hole 36. The securing holes 34 are positioned at lower distal portions of the surface plate 24, and the secondary receiving holes 36 are positioned along the rail 6. A fitted grommet or self-taping screw (not shown) inserted through the securing hole 34 and into the secondary receiving hole 36 will lock the bracket in place along the rail. The self-taping screw advanced past the stabilizer member plate backside 17 would lock into the channel to further secure the bracket. The securing and secondary receiving holes may be added before or after the assembly process by the user. To assist in securing the bracket within the channel, a textured sandpaper type surface (not shown) may be provided to the stabilizer member plate backside 17.

The second technique involves providing a tongue and groove type surface to surface 7*b* of opposing rails 6. For example, a wash-board or peak-and-valley type surface (not shown) could be added during the manufacturing process. The tongue and groove type surface would create a type of placement and securing structure to the shelf assembly at any location along the channel and rail wall construction.

Referring now to FIG. 2, the preferred assembly and insertion of bracket 10 within channel floor 4 is illustrated. Support member 20 is inserted into stabilizer member 12 at a slight angle. At the same time, a spring 30 is positioned on the first spring mount 40 and angled to receive the second spring mount 42 on the support member 20. FIGS 2B and 2C illustrate top, bottom, end, and side views of support member 20 and stabilizer member 12 to clearly define an embodiment of spring mounts 40 and 42. As illustrated in FIG. 2B, the second spring mount is located on the lower end of the spacer 25 between the support member plate 26 and surface plate 24. It will be appreciated by a skilled artisan that spring mount 40 does not have to be a stub as illustrated in FIG. 2B, but rather could be a hole having a depth within spacer 25 of support member 20 to receive spring 30. As the support member 20 is inserted into the stabilizer member 12, the backside 21 of support member plate 26 contacts the stabilizer member plate 18. With the stabilizer and support member plates 18, 26 adjacent and parallel to each other, the resultant bracket 10 is inserted into the channel 2 and the surface plate 24 fills the recess 8 to create a planar surface over the channel 2 of the slatrail 5. As depicted in FIG. 1 with upper bracket 10, before any shelf is inserted, the containing and support lips 14, 22 are adjacent to each other because of the pressure applied by the spring 30 between the stabilizer and support members 12, 20. The cutouts 19 of the stabilizer plate 18 are provided to expose the channel floor 4. With the channel floor exposed, the self-taping screw used in conjunction with the securing holes 34, 36 can be locked into the channel floor 4.

As mentioned above, the preferred multi-member bracket 10 of FIGS. 1–6 is shown in conjunction with a preferred slatrail wall construction 5. Similar to conventional slatwall, slatrail 5 provides a channel 2. However, slatrail, unlike slatwall, also provides opposing rails 6 defined by a recess 8. The recess 8 is provided within the surface of the slatrail 5 which provides functional support and enhances the visual appearance when used in conjunction with the preferred inventive brackets 10. When a bracket 10 is placed within the channel 2, the recess 8 nestles the surface plate 24 within the slatrail 5 and creates the appearance of a planar wall surface. With the surface plate 24 filling the void created by the recess 8, a torsion factor is created for the resultant shelf assembly, such that, when an object is supported in any position laterally spaced from the channel 2 the recess 8 provides resistance to the bracket by the adjacent support member 20. In addition, when the bracket assembly is locked within the channel by creating a pressure to channel floor 4 and the channel open roof 7*a* of the channel 2, the shear strength is increased because of the density of surface area in contact with the bracket assembly itself. Depending on the material used for the slatrail wall or only the rails 6 themselves, the structural integrity can be increased. The inventive slatrail 5, as shown in FIG. 2, is preferably made from natural solid wood materials such as oak, maple, or other hardwoods; or from manufactured materials such as a metal or a polyresin, similar to those used for the inventive bracket itself.

Figure 2A:
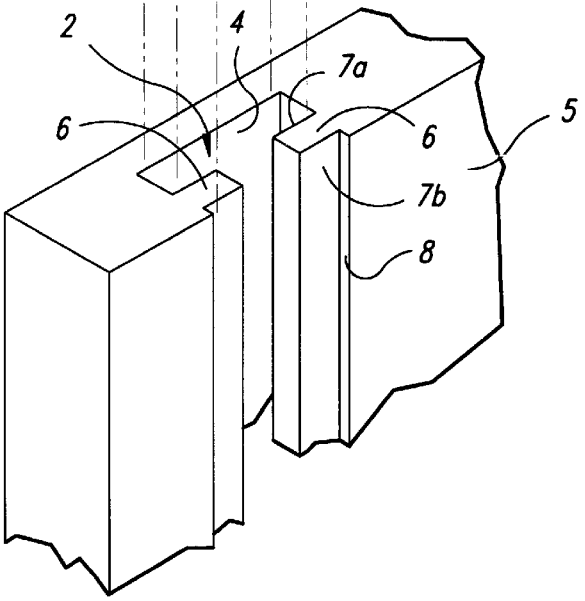
FIG. 2A illustrates a perspective view of an alternative embodiment of the slatrail.
Figure 2A:
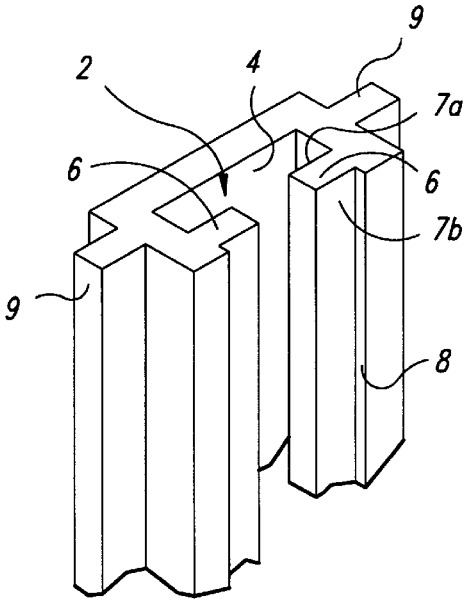
Figure 2B:
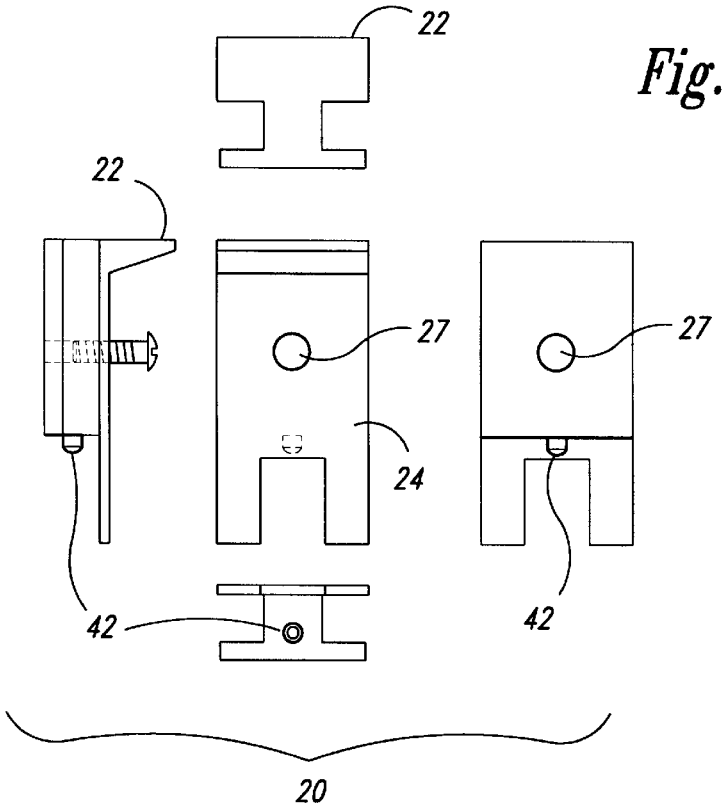
FIGS. 2B and 2C illustrate bottom, top, end, and side views of the inventive bracket of FIG. 2.
Figure 2C:
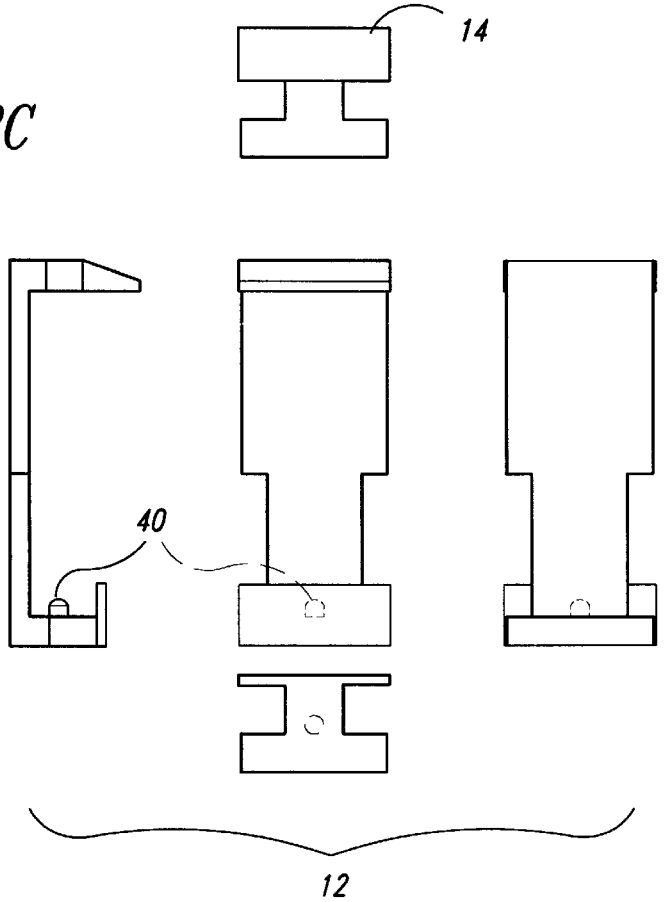

FIG. 2A illustrates an alternative embodiment of slatrail 5 formed preferably of the later materials of metal or a polyresin. With this embodiment, mounting wings 9 are attached or formed with the manufacturing mold of the slatrail 5, and assist with providing the alternative slatrail with any preexisting wall (not shown) provided by the user. Nails, screws or other means of attachment may be used to mount wings 9 of the slatrail of FIG. 2A to the preexisting wall or the mounting wings 9 merely inserted into receiving a preexisting wall channel (not shown).

To further illustrate the process of securing the brackets 10 within the channel 2, FIGS. 3A–3D show an enlarged cross-sectional views of the upper and lower brackets 10. FIGS. 3A and 3B show the securing screw 33 of upper bracket 10 (see FIG. 1) threaded into the support member 20, however, the securing screw 33 does not extend through the support member 20. At this stage, the bracket 10 moves freely within the channel 2. This unrestricted movement is created because the height $H_s$ of the spacer 25, located between the surface plate 24 and the upper channel support plate 26, is greater than the thickness of the rail 6. Additionally, the width $W_C$ and thickness of the adjacent stabilizing and support member plates 18, 26 is less than the respective thickness and width of the channel 2. Consequently, without some means to occupy the resultant voids $V_1$, $V_2$ and $V_3$, the bracket 10 moves freely within the channel 2.

Referring to FIGS. 3C and 3D, the securing screw 33 is advanced through the threaded support member 20 by tightening the screw. As the securing screw 33 exceeds past the support member plate backside 21 of the support member plate 26, it contacts stabilizer member plate 18 of the stabilizer member 12 and pushes the support member plate backside 21 away from the stabilizer member plate 18. Because of the limited space within the channel, this separation will continue until the top surface of the support member plate 26 contacts the open roof surface 7*a* of the channel 2, and the backside surface 17 of the stabilizer plate 18 contacts the channel floor 4 of the channel 2. At this point, the bracket is locked into place and the voids $V_1$, $V_2$, and $V_3$ are combined to a ingle void $V_T$. Depending on the weight of the shelf and items to be placed on top of the shelf supported by the bracket, the securing screw 33 can be advanced to establish the necessary pressure within the channel. The more the securing screw 33 is advanced, the more the stabilizer and support member plates 18, 26 will anchor into the channel 2. Additionally, as long as the stabilizer and support member plates 18, 26 are locked into place, the containing and support lips for the bracket are locked into the clamped position with the shelf. Consequently, if the shelf is clamped by the lips 14, 22 of the stabilizer and support members, respectively, securing the securing screw 33 will secure the lips 14 and 22 in the clamped position.

If the bracket uses the securing holes 36 of lower bracket 10 in FIG. 1, the process of securing the shelf assembly is slightly varied. Instead of placing the shelf between the containing and support lips 14, 22, a grommet or pin would be inserted into the securing holes to lock the bracket in place. Next, pressure would be applied upward against the stabilizer member 12 to establish the required distance between the containing and support lips 14, 22 for the desired shelf 32. As another embodiment of the inventive bracket, a rectangular hole (not shown) may be provided within a central portion of the stabilizer member to expose an adjacent portion of the channel with the securing screw. With the exposed channel, the process of tightening the securing screw would result in providing the end of the screw directly into the channel itself to lock the bracket in place.

With reference to FIGS. 4A and 4B, a preferred display unit is illustrated using the present invention. More particularly, FIG. 4A shows a front view of a display cabinet 60 using two brackets 10 for each shelf to provide a six shelf unit having twelve brackets 10. Each bracket 10 was inserted into the channel of the slatrail from the top of the display cabinet 60. Next, the laterally opposing brackets 10 were positioned within their respective channel. Once in position, the desired shelf is placed between the containing and support lips of the bracket and the securing screw is tighten to lock the bracket in place. In order to quickly position the opposing brackets in place along the channel, a preprinted sheet having horizontal lines can be placed against the back wall 61 for reference or a tape measure may be used. To increase the decorative appearance or strength of display cabinet 60, various types of shelves having varying thickness' can be used. For example, wood shelf 64 is thicker than shelves 62 and 66 of glass and metal, respectively. Because there are no preset bracket mounting locations with the bracket system of the present invention, the only limitation for the number of shelves that can be added is limited to the distance between the shelves. Consequently, as long as the shelves are at least spaced apart by the length of the stabilizer bracket, a shelf can be added. The length of the preferred bracket assembly is about two inches, however, as mentioned earlier, the dimensions of the bracket can vary depending on the size and weight of the items to be displayed. In turn, the same preferred bracket assembly can also accommodate a shelf thickness up to about ¾ inch without spring 30 or ½ inch with spring installed.

Depending on the depth of the shelving unit, other brackets can be added to support a shelf with the addition of the respective slatrail channels along the depth or the back wall 61 of the unit 60. Adversely, with or without the addition of new channels, individual brackets (not shown) with specific platforms can accommodate a single item 68 or multiple small light weight items 68A within the unit 60.

FIG. 4B illustrates a cross-sectional view B of the shelf assembly unit 60 of FIG. 4A. In this view, shelf 69 illustrates another embodiment of the present invention. The reference line r indicates an angle of about two degrees relative to the planar floor surface. This is made possible by manufacturing the surfaces of the containing and support lips 14, 22 of the inventive brackets 10 with the same angle. The slight angle provided by the bracket lips help to prevent items 68 on the shelf 69 from ever falling off the shelf front side 70.

The process of releasing the secured bracket for either removal or positioning is merely the process of reversing the steps for securing the bracket after the shelf is removed. The grommets, if utilized, are removed and the securing screw(s) is loosened until the bracket moves freely within the channel. Depending on the size of the shelf, it may be left in while adjusting the brackets.

Similar to the brackets 10 used for shelf 69 of FIGS. 4A and 4B, FIG. 5 illustrates another embodiment of a bracket having angled containing and support lips. More specifically, bracket 75 provides angled containing and support lips for clamping a shelf attached to an angled slatrail 5. The containing and support lip surfaces 77, 79 provide an angle of about three degrees relative to the perpendicular surface of the bracket or channel.

As illustrated with FIG. 6, bracket 75 can be used for a portable or free standing display units having walls that are not perpendicular to the planar floor surface. More particularly, the inventive portable display unit can support a shelf with a single bracket or multiple brackets. Bracket 75 has also been altered by eliminating the restraining plate 16 illustrated in FIG. 1, thereby exposing the retaining spacer wall 76.

All of the embodiments of the present invention to this point have been based on a multi-member structure. For reasons of simplicity, utility and/or cost, a unitary structure of the present invention can be manufactured as illustrated in FIG. 7. As mentioned above with respect to the other multi-member bracket embodiments, the unitary bracket structure can be modified to accommodate the desired use. For example, depending on the strength or look desired, various woods and/or metals can be formed or common molding techniques of composite material can be utilized to provide the desired structure. Additionally, both the multi-member and unitary bracket assembly can be used with either the inventive slatrail or conventional slatwall.

The shape of the unitary bracket embodiment is the same as the multi-member bracket 10 of the previous embodiments, however, the spring 30 and the stabilizer member 12 are eliminated. Additionally, the thickness of the support channel plate 83 has been increased to provide a similar size and shape of the channel 85. Consequently, when the securing screw 92 is used to lock the bracket in the channel 85 of the slatwall 81, the pressure applied by the securing screw 92 is between the slatwall channel surface 87 and a rail surface 89. An alternative embodiment to prevent the securing screw 92 from engaging into the channel can include attaching a flap over the unitary bracket channel surface adjacent to the slatwall channel surface 87. This flap would preferably be constructed of the same composite material used for the bracket and would rest against the slatwall channel surface 87. When the securing screw 92 is tightened, the flap would be pushed against the slatwall channel surface 87 thereby locking the bracket in place and preventing the screw from piercing the channel 85.

In addition to the unitary brackets 80, 82, 84, FIG. 7 also illustrates various support lip alternatives. By using the support surface 91 of bracket 80, a single item or a few light weight items if desired can be displayed with the use of a support shelf. At the opposite end of bracket 80, an angled support surface 93 is shown to help support another matching support surface 94 of bracket 82 when an angle shelf is desired. These angles brackets exemplify how shelf 69, of FIG. 4B, could be provided. Bracket 82 also illustrates the use of an allen screw 90 for securing a bracket within the channel. The allen screw 90 allows for the securing element to be hidden when the bracket is locked in place. Bracket 84 illustrates another support shelf 96 which may be used by itself to support a planar shelf or in conjunction with another support surface 95 of bracket 82. Attached to the opposite end of bracket 84, a hook 97 is illustrated for receiving display items that may be hung. Lastly, as another means for securing the bracket 84 within the channel, a self-tapping wood screw 92 is shown with bracket 84. Again, self-tapping screw 92, like the allen screw 90, allows for the securing element to be hidden when the bracket is locked in place.

Any or all of the various securing and support surfaces illustrated with respect to FIG. 7 may be utilized with the multi-member bracket structure without taking away from the scope of the invention.

The present invention provides means to adjust shelf spacing to store or display items. For example, spools or thread, spice containers, miniatures and/or small collectibles may be effectively and efficiently stored or displayed without the restriction of predetermined spacing between shelves.

With the present multi-member and unitary bracket embodiments of the present invention, typical slatwall can now be used with the channel provided at any angle relative to the planar surface of the floor. However, by using slatrail with the present inventive bracket embodiments, not only is the structural integrity of slatwall increased so that heavier object can be displayed, but the user can display or store items wherever desired. Consequently, if slatwall can be used vertically, it is conceivable that slatwall can be used in smaller proportions than a display wall for merchandise. For example, slatwall can be provided in small furniture type display or counter top display units where various dimensionally different objects need to be displayed. Fortunately, with the use of the inventive slatrail, a cosmetically appealing and functionally robust channel and rail wall construction can be used in conjunction with the various multi-member and unitary bracket embodiments to provide the ultimate shelf assembly for years to come for any display system, e.g. floor, wall or otherwise.

It is to be understood that many variations in size, shape, and construction can be made to the illustrated and above-described embodiments without departing from the spirit and scope of the present invention. Some of the features of the preferred embodiment may be utilized without other features. Therefore, it is to be understood that the presently described and illustrated embodiments are non-limitive and is for illustration only. Instead, my patent is to be limited for this invention only by the following claim or claims interpreted according to accepted doctrine of claim interpretation, including the doctrine of equivalents and reversal of parts.

What is claimed is:

1. A post and bracket system, comprising:

a wall construction having a channel extending predetermined length within said wall and having a width and depth and at least one open end;

an opening within a central portion of said channel width extending said channel length to expose said channel and form opposing rails having an inner and an outer surface of said channel;

a recess within said outer surface above said channel having a depth less than the depth of said channel depth and a width corresponding to said channel width;

a channel stabilizer plate;

a T-shaped containing lip attached perpendicular to a first end of said stabilizer plate;

a barrier wall attached perpendicular to a second opposite end of said stabilizer plate;

a channel support plate shaped to fit adjacent to said stabilizer plate and laterally spaced between said containing lip and barrier wall;

a T-shaped surface plate attached perpendicular to said support plate;

a support lip attached perpendicular to one end of said surface plate and;

a securing element having means for locking the bracket assembly along said channel.

2. The bracket assembly of claim 1 wherein said surface plate and said barrier wall further includes spring mounts.

3. The bracket assembly of claim 2 further including a spring element contained within lateral space between said barrier wall and said T-shaped surface plate.

4. The bracket assembly of claim 1 wherein opposing planar surfaces of said containing and support lips are textured.

5. The bracket assembly of claim 4 wherein said spring member provides pressure between said containing and support lips when an object is clamped therebetween.

6. The bracket assembly of claim 1 wherein the adjoined stabilizer and support plates have a corresponding shape as said channel.

7. The bracket assembly of claim 1 wherein said securing element is threaded within and through said T-shaped surface plate and said support plate.

8. The bracket assembly of claim 1 further including a safety-lock hole positioned at a lower distal portion of said surface plate.

9. The bracket assembly of claim 1 wherein said barrier wall further includes a retaining plate attached to said barrier wall parallel to the planar surface of said opposing rails.

10. The bracket assembly of claim 1 wherein the containing and support lips are attached perpendicular to said first end of said stabilizer plate and to said one end of said surface plate, respectively.

11. The bracket assembly of claim 1 wherein the stabilizer plate further includes a surface texture selected from the group consisting of wash-board, peak-and-valley, or sandpaper.

12. The bracket assembly of claim 1 wherein said opposing rails further include securing holes.

13. The wall construction of claim 1 wherein the outer wall surface of said recess further including positioning holes extending through said rail.

14. A method for using an adjustable bracket assembly with an open channel support construction, the steps comprising:

providing a stabilizer member including a channel stabilizer plate having a T-shaped containing lip attached perpendicular to a first end of said stabilizer plate and a barrier wall attached perpendicular to a second opposite end of said stabilizer plate;

providing a support member including a channel support plate shaped to fit within said stabilizer member laterally spaced between said containing lip and barrier wall having a T-shaped surface plate attached perpendicular to said support plate and a support lip attached perpendicular to one end of said surface plate;

inserting the support member into said stabilizer member to adjoin said channel plates and to form a clamping structure between said containing and support lips, said support and stabilizer members being laterally spaced between said containing lip and barrier wall and forming said bracket assembly;

inserting the adjoined stabilizer and support channel plates of said bracket assembly into the open channel of said wall;

positioning said inserted bracket assembly within said channel;

adjusting said support member between said containing lip and barrier wall with said wall to provide a space between said containing and supporting lip; and tightening a securing element through said support member to contact and separate said stabilizer plate from said support plate within said channel.

15. The method of claim 14 wherein said step of fixedly mounting a locking element further includes the step of advancing said locking element at said desired position on said vertical wall to separate the top and bottom channel plates within said vertical channel.

* * * * *